US006193171B1

(12) United States Patent
Albertson

(10) Patent No.: US 6,193,171 B1
(45) **Date of Patent: *Feb. 27, 2001**

(54) WATER PULSATOR

(76) Inventor: Patricia J. Albertson, 2100 Shadywood Rd., Wayzata, MN (US) 55391

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/247,205

(22) Filed: Feb. 9, 1999

Related U.S. Application Data

(60) Provisional application No. 60/074,072, filed on Feb. 9, 1998.

(51) Int. Cl.[7] ..... B05B 3/04
(52) U.S. Cl. ..... 239/381
(58) Field of Search ..... 239/380, 381, 239/382, 383

(56) References Cited

U.S. PATENT DOCUMENTS

| | | | | |
|---|---|---|---|---|
| D. 225,736 | | 1/1973 | Mango et al. . | |
| D. 379,491 | | 5/1997 | Goodin . | |
| D. 383,522 | | 9/1997 | Guo . | |
| 4,101,075 | * | 7/1978 | Heitzman | 239/383 |
| 4,117,979 | * | 10/1978 | Lagarelli et al. | 239/381 |
| 4,254,914 | * | 3/1981 | Shames et al. | 239/383 |
| 4,350,158 | * | 9/1982 | Hudson | 239/381 |
| 4,534,512 | | 8/1985 | Chow et al. . | |
| 5,397,064 | * | 3/1995 | Heitzman | 239/381 |
| 5,467,927 | * | 11/1995 | Lee | 239/383 |
| 5,630,548 | | 5/1997 | Chih . | |
| 5,632,446 | * | 5/1997 | Krochek | 239/381 |

* cited by examiner

*Primary Examiner*—Andres Kashnikow
*Assistant Examiner*—Christopher S. Kim

(57) ABSTRACT

A fluid dispenser having a hand operated valve has a pulsator for discharging sequential pulses of liquid when the valve is open. The pulsator has a liquid diverter that directs several streams of liquid toward an impeller for rotating the impeller. The impeller has a fluid blocking plate that sequentially interrupts the flow of liquid through the fluid dispensing orifices located in a head located adjacent the impeller.

17 Claims, 6 Drawing Sheets

WATER PULSATOR

This application claims benefit to U.S. provisional application Ser. No. 60/074,072, filed Feb. 9, 1998.

FIELD OF THE INVENTION

The invention is in the art of fluid dispensers for directing fluid to a selected location. The fluid dispenser is a pistol grip hose nozzle having a pulsator for sequentially pulsing the liquid discharged from the nozzle.

BACKGROUND OF THE INVENTION

Pistol grip nozzles coupled to hoses and tubes carrying liquids, such as water, are used to control the dispensing of the liquids. The modes of operation of pistol grip nozzles have been adjusted to offer no flow, solid cone sprays and solid jet sprays. These liquid sprays are continuous patterns to achieve the waste of water. H. Chow and S. J. Goodman in U.S. Pat. No. 4,534,512 describe a pistol grip nozzle having a turret rotatable on a barrel to change the continuous spray patterns of water discharged from the nozzle. The discharged water does not change velocity or pulse as it exits from the nozzle.

SUMMARY OF THE INVENTION

The invention resides in a liquid pulsator useable with a pistol grip nozzle to discharge pulses of liquid, such as water, to a selected location. The pistol grip nozzle has a hand operated lever that is manually moved to control the flow of liquid to the pulsator attached to the nozzle. The pulsator has a case adapted to be mounted on the nozzle. Located within the case is a pulsator head that sequentially blocks the flow of liquid through orifices in the head to alter the flow velocity of the liquid exiting from the head thereby creating liquid pulses. The pulsator head includes a diverter that directs several streams of liquid toward an impeller. The moving streams of liquid rotate the impeller. The impeller has a member that intermittently blocks the flow of liquid through liquid discharge orifices in the head and allows liquid to flow through the orifices. This causes liquid pulses having different liquid flow rates. The pulsating liquid conserves liquid and increase cleaning effectiveness of the liquid discharged on a surface.

DESCRIPTION OF PREFERRED EMBODIMENTS

Figure 1:
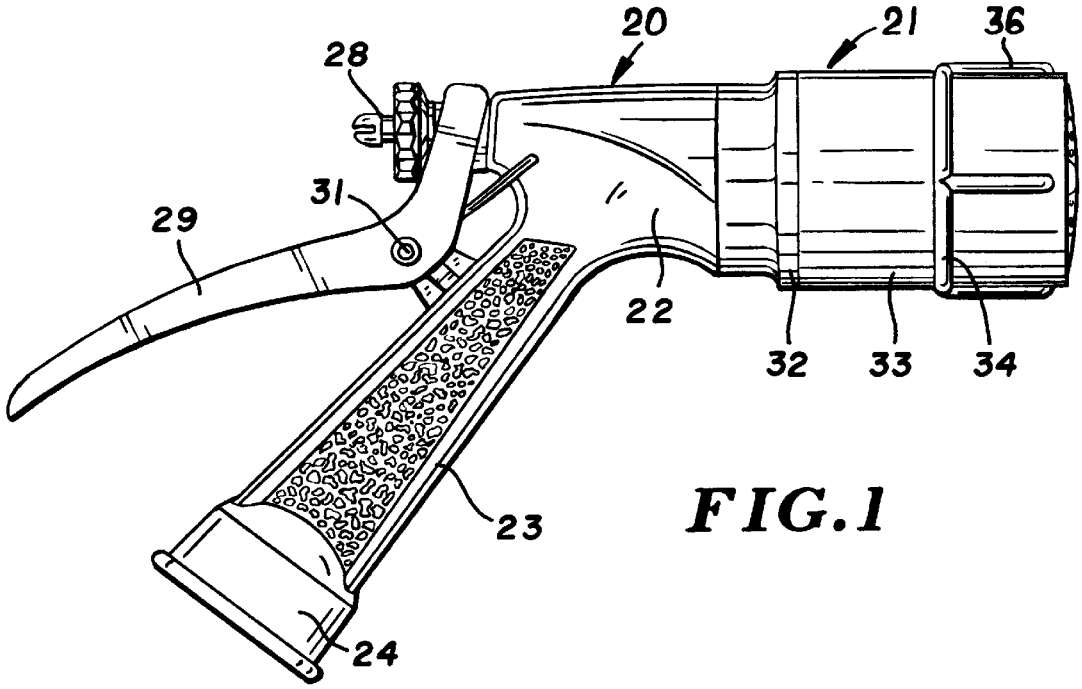
FIG. 1 is a side elevational view of a fluid dispenser and fluid pulsator of the invention.
Figure 2:
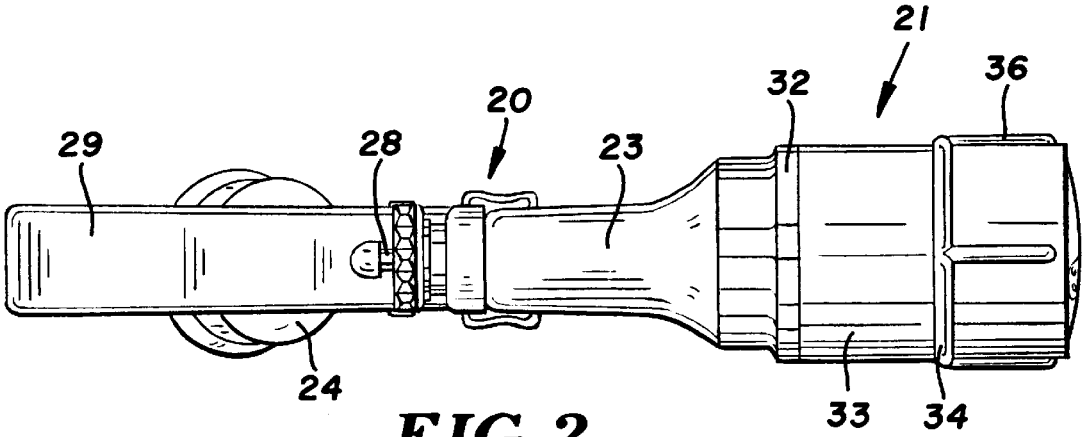
FIG. 2 is a top view thereof.
Figure 3:
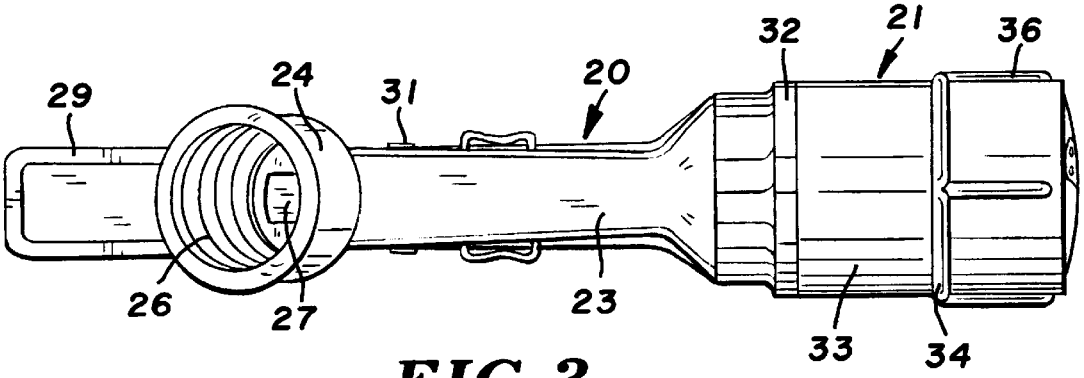
FIG. 3 is a bottom view thereof.
Figure 4:
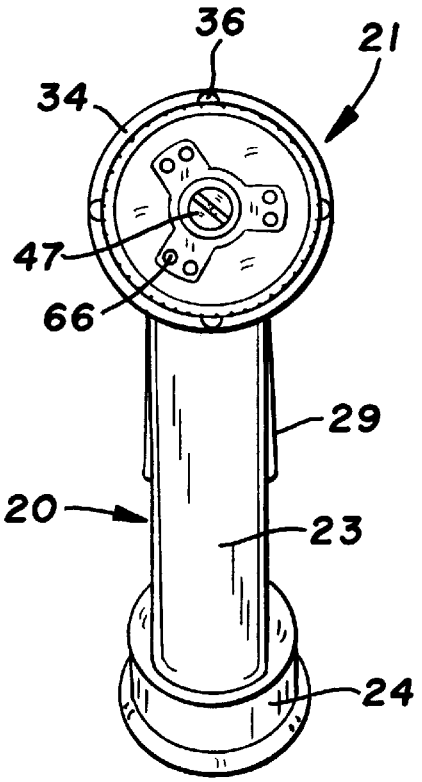
FIG. 4 is a front elevational view thereof.
Figure 5:
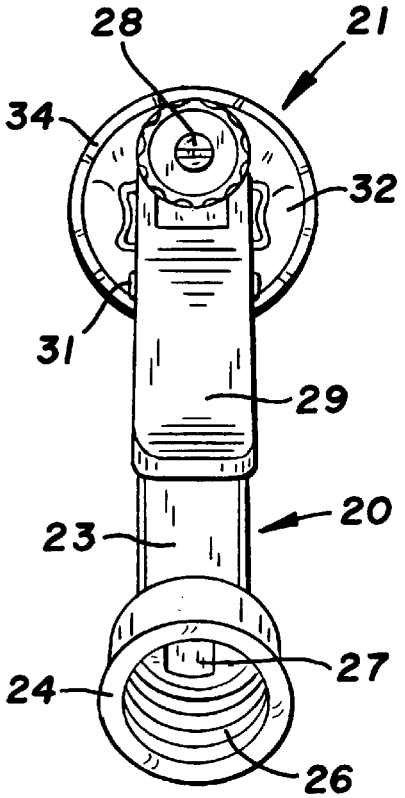
FIG. 5 is a rear elevational view thereof.
Figure 6:
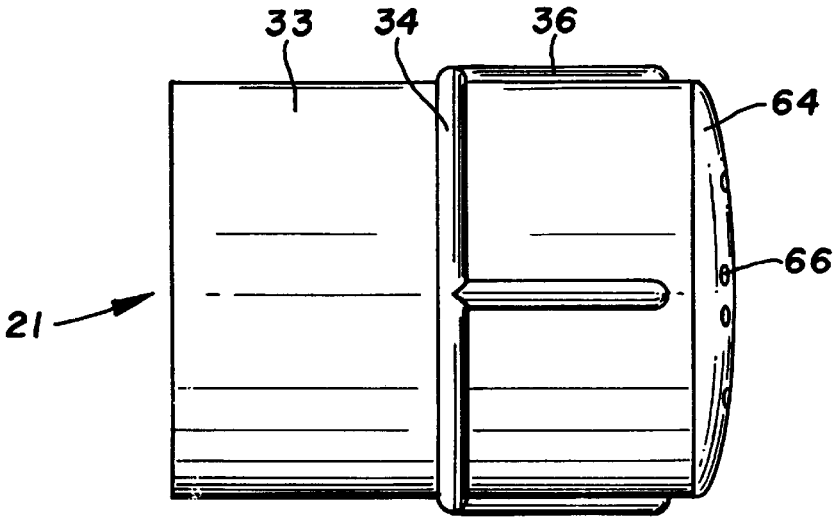
FIG. 6 is an enlarged side elevational view of the pulsator.
Figure 7:
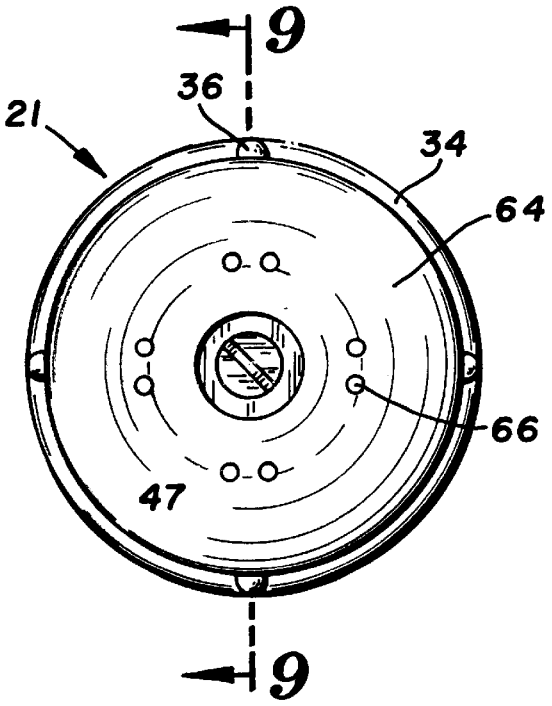
FIG. 7 is a front view of FIG. 6.
Figure 8:
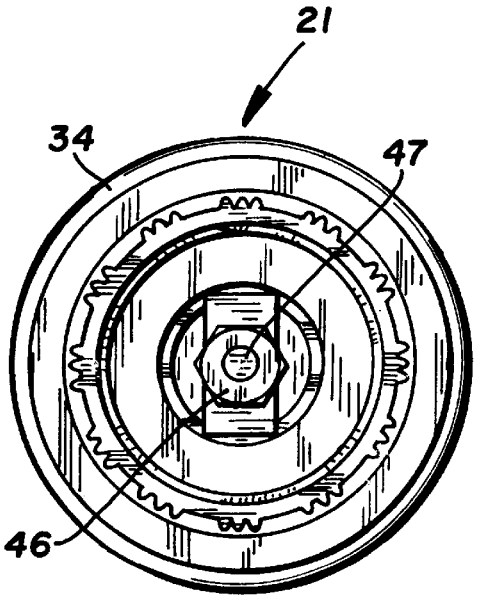
FIG. 8 is a rear view of FIG. 6.

Referring to FIGS. 1 to 5, there is shown a fluid dispenser 20 joined to a fluid pulsator 21 operable to pulse fluid discharged from the dispenser. Dispenser 20 is a pistol grip hose nozzle having a body 22 joined to a downwardly directed handle 23. A collar 24 joined to the lower end of handle 23 has internal threads 26 to accommodate external threads of a hose or tubular member carrying liquid, such as water, to dispenser 20. Handle 23 has a passage 27 open to a passage (not shown) in body 22. The flow of liquid through body 22 is controlled with a valve 28. A hand operated lever 29 pivotally connected with a pivot pin 31 to handle 23 is manually moved to open valve 28 to allow fluid to flow through body 22 to pulsator 21. A spring biases the valve to a closed position. Body 22 has an external threaded end 32 accommodating pulsator 21. Examples of pistol grip hose nozzles are shown by H. Chow and S. J. Goodman in U.S. Pat. No. 4,534,512 and I. S. Chih in U.S. Pat. No. 5,630,548. The valve and lever structures of these patents are incorporated herein by reference.

Figure 9:
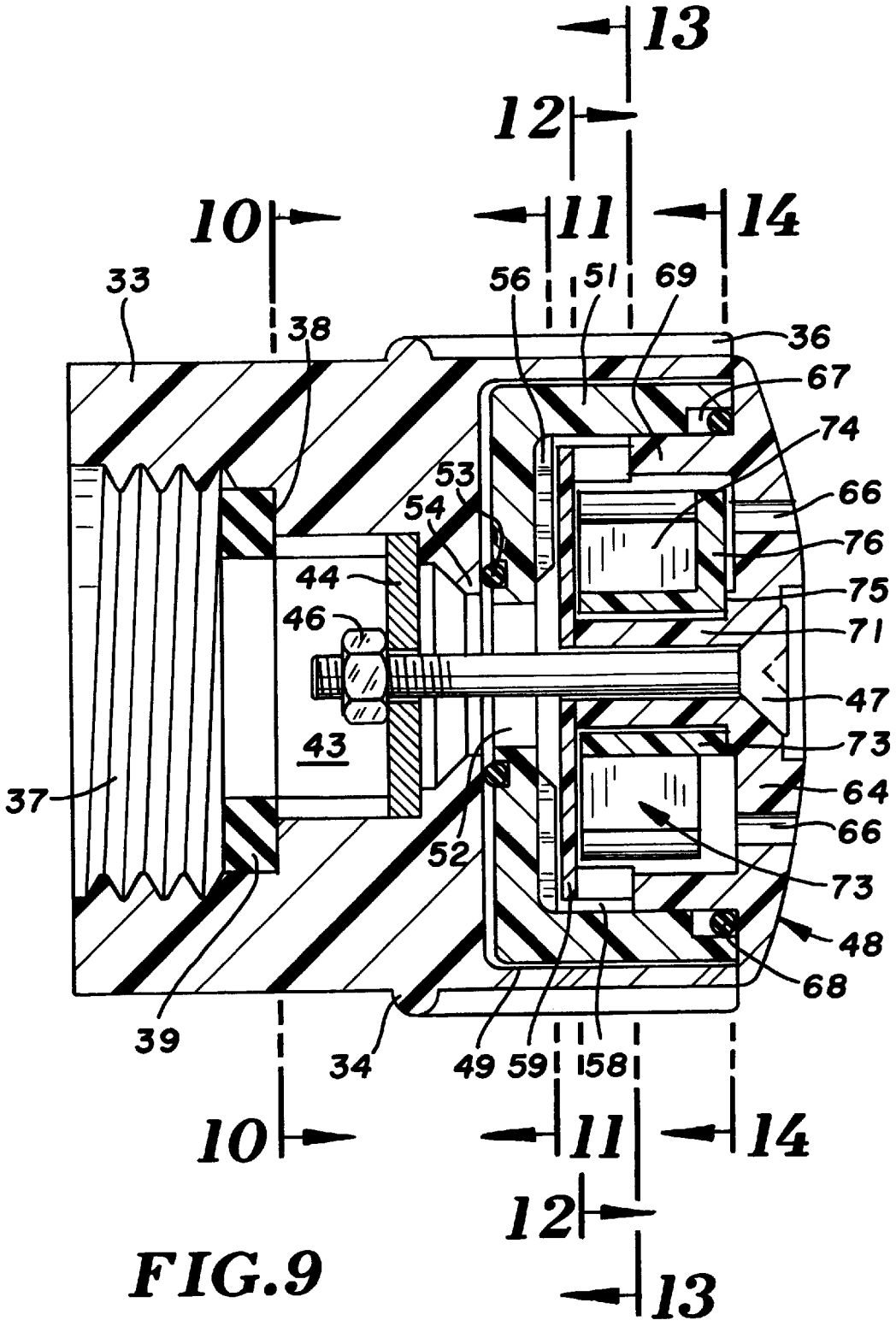
FIG. 9 is an enlarged sectional view taken along the line 9—9 of FIG. 7.

Pulsator 21 has a cylindrical case or housing 33 threaded on the end 32 of body 22. An outwardly directed rib 34 surrounds the mid section of case 33. Circumferentially spaced axial ribs 36 on case 33 extend forwardly from rib 34 to facilitate turning of case 33 onto and off of end 32 of body 22. As shown in FIG. 9, case 33 has a threaded internal wall 37 extended to an inwardly directed annular shoulder 38. An annular rubber or plastic washer 39 located in engagement with shoulder 38 contacts the end 32 of body 22 when case 33 is threaded on end 32.

Figure 10:
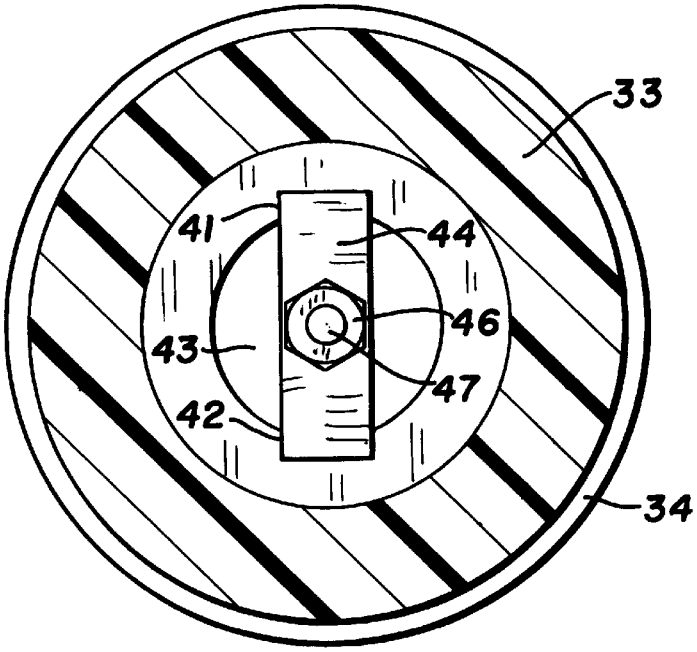
FIG. 10 is a sectional view taken along the line 10—10 of FIG. 9.

As shown in FIG. 10, body 22 has a pair of grooves 41 and 42 open to a passage 43 accommodating opposite ends of a bar 44. Bar 44 is an anchor for a nut 46 threaded onto a bolt 47. Bolt 47 holds a pulsator head 48 in a pocket 49 in the outer end of case 33.

Pulsator head 48 has a cup-shaped housing 51 having a central opening 52 open to passage 43. An annular seal or O-ring 53 surrounding opening 52 engages an annular lip 54 on case 33 to prevent liquid from flowing around housing 51. The inside of housing 51 has circumferentially spaced radial ribs 56 that direct liquid outwardly from opening 52, shown by arrows 57 in FIG. 11, into an annular chamber 58. A liquid diverter 59 having inclined openings 61 in an annular flange directs a number of streams of liquid, shown by arrows 62 in FIGS. 12 and 13, inwardly into a chamber 63. Diverter 59 is a pan-shaped member having a circular flange or rim containing inclined openings 61. The circular flange is spaced radially inwardly from housing 51 providing the inner annular wall of chamber 58. The flange, shown in FIGS. 12 and 13, has eight inclined openings 61 circumferentially spaced around the flange. The size and number of inclined openings can vary to change the flow of liquid into central chamber 63.

Returning to FIG. 9, a head 64 having holes or orifices 66 is clamped to housing 51 with bolt 47. Bolt 47 threaded into nut 46 holds head 64 into engagement with housing 51 and forces O-ring 53 into sealing engagement with lip 54. Housing 51 has an annular groove 67 containing an O-ring 68 that engages head 64 to prevent leakage of liquid between housing 51 and head 64. Head 64 has an annular flange 69 telescoped into housing 51 to confine O-ring 68 to groove 67 and hold diverter 59 in engagement with ribs 56 to prevent rotation of diverter 59.

Figure 12:
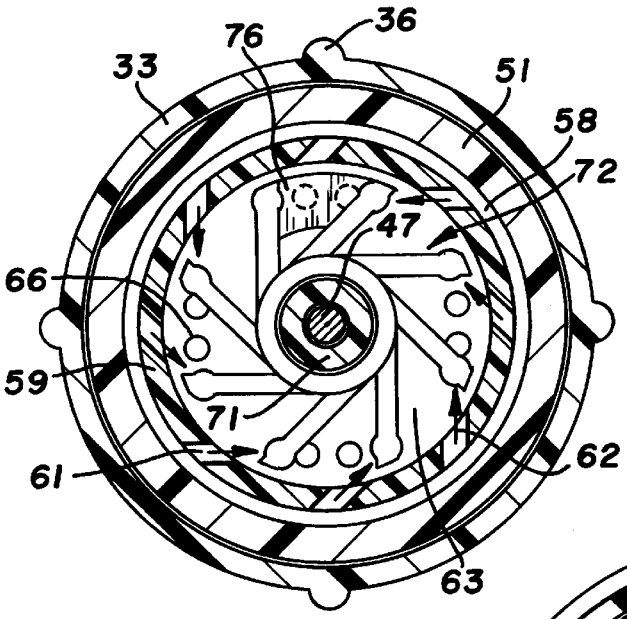
FIG. 12 is a sectional view taken along the line 12—12 of FIG. 9.
Figure 13:
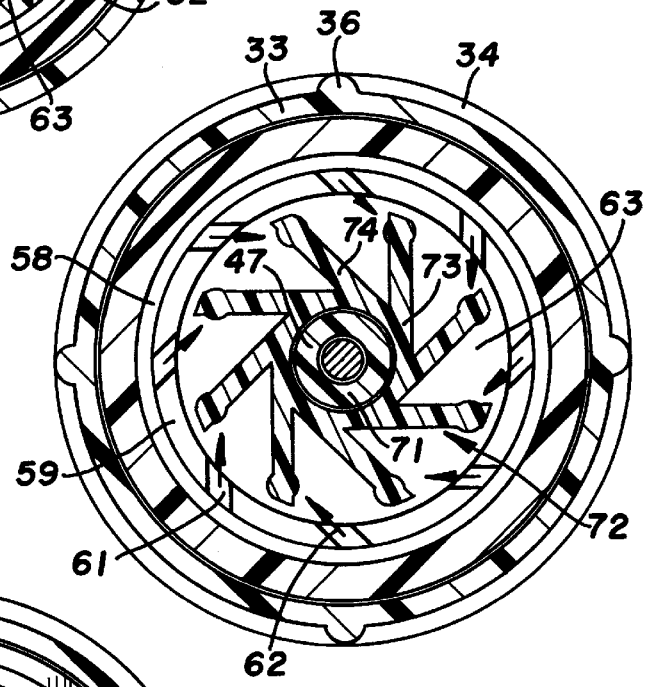
FIG. 13 is a sectional view taken along line 13—13 of FIG. 9.
Figure 14:
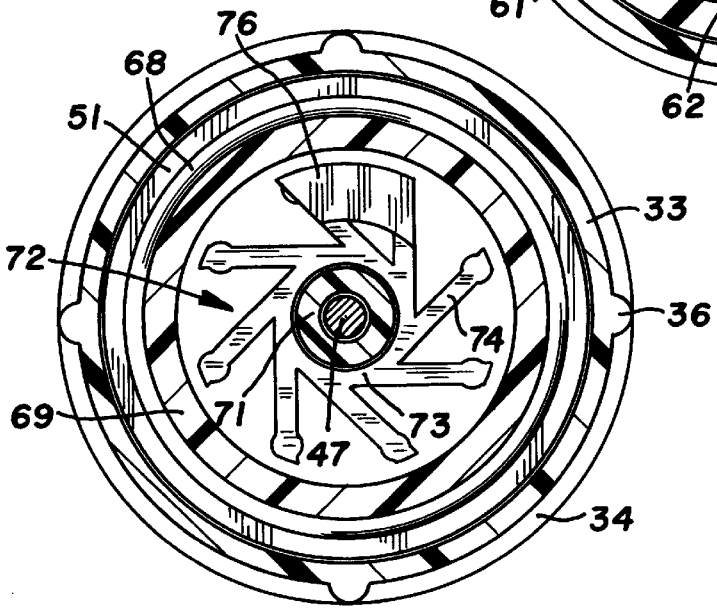
FIG. 14 is a sectional view taken along the line 14—14 of FIG. 9.

Head 64 has an inwardly directed tubular boss 71 accommodating bolt 47 and providing a cylindrical support or bearing for an impeller 72. Impeller 72 has a sleeve 73 rotatably mounted on boss 71. Sleeve 73 is spaced from diverter 59 and bears against a small shoulder 75 on the inside of head 64. Impeller 72 is free to rotate on boss 71. A plurality of tangently directed blades or vanes 74 are joined to sleeve 73. The outer ends of each vane 74 is spaced adjacent the inside of diverter 59 so that the jets of liquid flowing from inclined openings 61 impinge on the vanes causing impeller 72 to rotate on boss 71 in chamber 63. As shown in FIGS. 12 to 14, impeller 72 has eight vanes 74 circumferentially spaced around sleeve 73. The number and shapes of the vanes can vary. An arcuate member 76 joined to adjacent vanes, as seen in FIGS. 9, 12 and 14, sequentially covers holes 66 in head 64 as impeller 72 rotates in chamber 63. The member 76 is a flat plate or baffle joined to ends of adjacent vanes and located adjacent the inside annular wall of head 64 and aligned with the holes 66 in head 64. This causes the liquid flowing through holes 66 in head 64 to pulse as the flow of liquid to holes 66 is sequentially cut off and opened to chamber 63.

Figure 11:
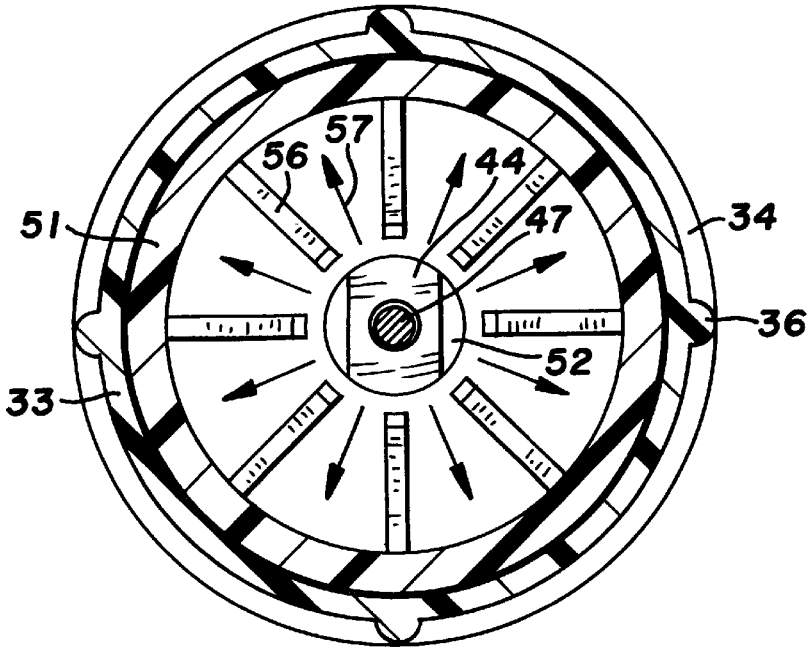
FIG. 11 is a sectional view taken along the line 11—11 of FIG. 9.

In use, liquid dispenser 20 operates to control the flow of liquid to pulsator 21. When dispenser valve 28 is open liquid under pressure flows through passage 43 in case 33 and through opening 52. As shown in FIG. 11, radial ribs 56 divide the flow of liquid into separate streams shown by arrows 57. The liquid flows into an annular chamber 58 surrounding diverter 59. The inclined openings 61 in diverter 59 direct streams of water, shown by arrows 62, into chamber 63 containing impeller 72. The flowing liquid streams 62 rotate impeller 72. The baffle 76 turns with impeller 72 to sequentially cover and uncover orifices 66 in head 64 to cause liquid to pulse as it exits from orifices 66. The pressure of the liquid flowing through pulsator 21 determines the liquid pulse rate and velocity of liquid discharged from the pulsator. The pulse rate and velocity of the liquid increases as the pressure of the liquid increases.

What is claimed is:

1. An apparatus for dispensing pulses of a liquid to a selected location comprising: a liquid dispenser operable to discharge a liquid, a pulsator connected to the dispenser operable to receive liquid from the dispenser and discharge pulses of liquid, said pulsator having a case, said dispenser and case having releasable connection means mounting the case on the dispenser, said case having a first opening in communication with the liquid dispenser for receiving liquid from the dispenser and a cylindrical pocket open to the first opening, said pocket having an open end, a pulsator head assembly located in the pocket in the case, said head assembly having a cup-shaped housing located in the pocket having a base with a second opening located adjacent the first opening and an internal chamber, seal means between the base and case surrounding the second opening, a liquid diverter for directing separate streams of liquid into the internal chamber in the pulsator head assembly, an impeller located within the internal chamber, a head extended across and closing the open end of the pocket and engageable with the casing and housing, said head having orifices for discharging liquid to the selected location, a cylindrical tubular boss on the head extended into the chamber for mounting the impeller within the chamber for rotation around the boss by the separate streams of liquid directed into the chamber, liquid blocking means on the impeller located adjacent said orifices during rotation of the impeller to restrict the flow of liquid through said orifices to cause said liquid flow from the head to pulse, bolt means extended through the cylindrical boss, and anchor means mounted on the case cooperating with the bolt means to releasably hold the head in engagement with the case and housing and seal means in engagement with the case, said bolt means being removable from the anchor means to allow the pulsator head assembly to be removed from the case.

2. The apparatus of claim 1 wherein: the liquid dispenser is a pistol grip nozzle having a liquid outlet end, said case of the pulsator being mounted on the liquid outlet end.

3. The apparatus of claim 1 wherein: said diverter has a plurality of inclined openings for directing liquid into the chamber in a generally circumferential direction to rotate the impeller.

4. The apparatus of claim 3 wherein: the impeller has a sleeve and vanes inclined outwardly from the sleeve.

5. The apparatus of claim 4 wherein: the blocking means is secured to at least one vane.

6. The apparatus of claim a wherein: said impeller has a sleeve rotatably mounted on the boss and vanes secured to said sleeve.

7. The apparatus of claim 6 wherein: the blocking means is secured to at least one vane.

8. A pulsator for discharging pulses of liquid comprising: a case having a passage for receiving a liquid under pressure and a cylindrical pocket open to the passage to allow liquid to flow from the passage into the pocket, said pocket having an open end, a pulsator head assembly located within the pocket, said head assembly having a liquid diverter for directing separate streams of liquid into an internal chamber in the pulsator head assembly, an impeller located within the internal chamber of the head assembly, a head extended across and closing the open end of the pocket and engageable with the casing, said head having orifices for discharging liquid to the selected location, a cylindrical tubular boss on the head extended into the chamber for mounting the impeller within the chamber for rotation by the separate streams of liquid directed into the chamber, liquid blocking means on the impeller located adjacent said orifices during rotation of the impeller to restrict the flow of liquid through said orifices to cause said liquid flow from the head to pulse, fastening means extended through the cylindrical tubular boss, and anchor means mounted on the case cooperating with the fastening means to releasably hold the head in engagement with the case to close the open end of the pocket, said fastening means being removeable from the anchor means to allow the pulsator head assembly to be removed from the case.

9. The pulsator of claim 8 wherein: said diverter has a plurality of inclined openings for directing liquid into the chamber in a generally circumferential direction to rotate the impeller.

10. The pulsator of claim 9 wherein: the impeller has a sleeve and vanes inclined outwardly from the sleeve.

11. The pulsator of claim 10 wherein: the blocking means is secured to at least one vane.

12. The pulsator of claim 8 wherein: said impeller has a sleeve rotatably mounted on the boss and vanes secured to said sleeve.

13. The pulsator of claim 12 wherein: the blocking means is secured to at least one vane.

14. The pulsator of claim 8 wherein: the fastening means extended through the cylindrical tubular boss is a bolt, and said anchor means includes nut means for accommodating the bolt to secure the pulsator head assembly to the case.

15. The pulsator of claim 8 wherein: the liquid diverter includes a pan-shaped member located in the internal chamber of the head assembly.

16. The pulsator of claim 15 including: seal means between the head assembly and the case, and said fastening means cooperating with the anchor means to retain the seal means in engagement with the head assembly and the case.

17. The pulsator of claim 16 wherein: the seal means is an O-ring mounted on the head assembly and engageable with the case around the passage in the case.

* * * * *